United States Patent [19]

Ishizawa

[11] 4,030,951

[45] June 21, 1977

[54] METHOD OF HARDENING SAW TEETH

[75] Inventor: Toushichi Ishizawa, Shizuoka, Japan

[73] Assignees: Fuji Sangyo Kabushiki Kaisha, Fujieda; Seiya Ishizawa, Shizuoka, both of Japan

[22] Filed: May 24, 1976

[21] Appl. No.: 689,465

[30] Foreign Application Priority Data

May 26, 1975 Japan ..... 50-63205

[52] U.S. Cl. ..... 148/147; 148/151; 148/152; 148/153; 148/157

[51] Int. Cl.[2] ..... C21D 9/24

[58] Field of Search ..... 148/147, 151, 152, 153, 148/157

[56] References Cited

UNITED STATES PATENTS 3,923,561 12/1975 Ishizawa et al. ..... 148/147

*Primary Examiner*—R. Dean

*Attorney, Agent, or Firm*—Browdy and Neimark

[57] ABSTRACT

This invention provides a method for hardening sawteeth which comprises contacting running water with the top ends of sawteeth in air, blowing flames to the top ends of the sawteeth in this state to thereby blow off the running water at parts enveloping the top ends of the sawteeth and heat only the top ends of the sawteeth at a hardening temperature, and then shifting the sawteeth to separate the heated sawteeth from a sphere of influence of the flames and simultaneously cool the sawteeth with the running water. According to this method, the top ends of respective sawteeth of a band saw can be uniformly hardened by a very simple operation without using a hardening apparatus having a complicate structure.

4 Claims, 6 Drawing Figures

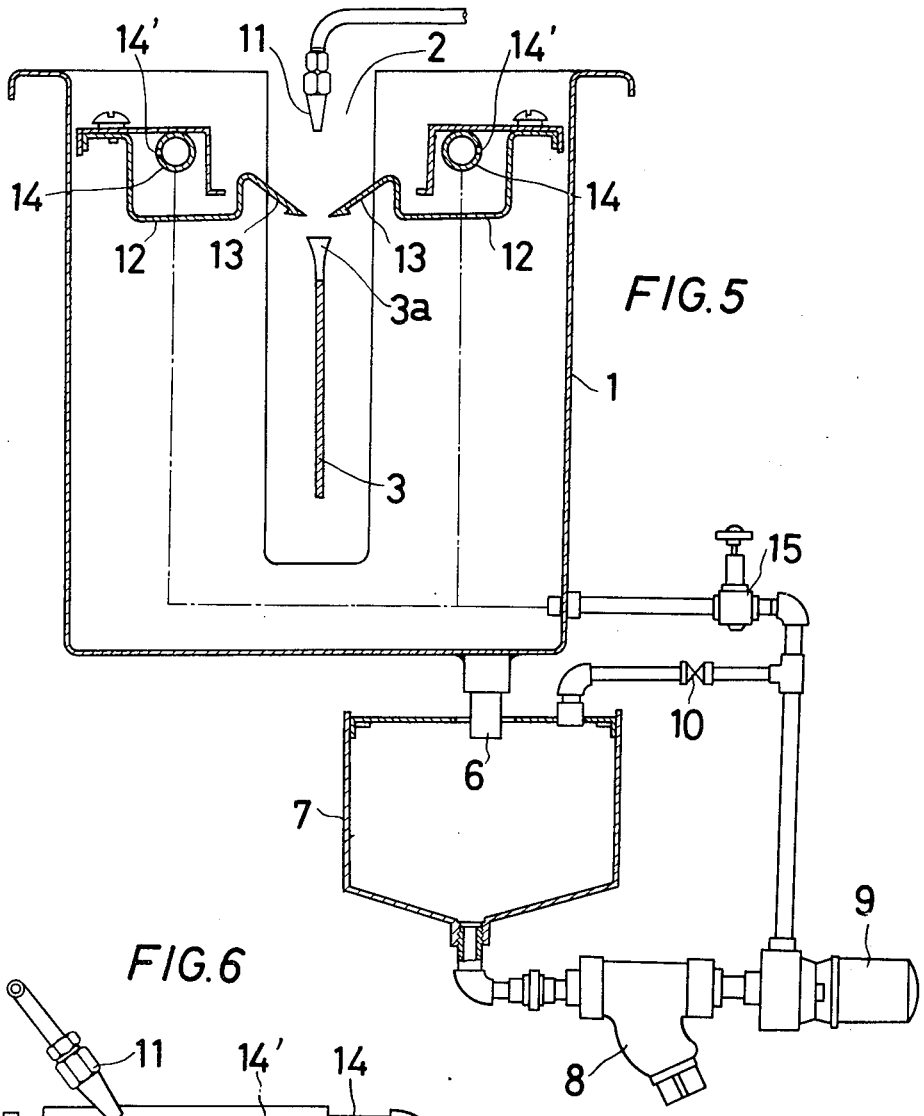
FIG. 5
FIG. 6
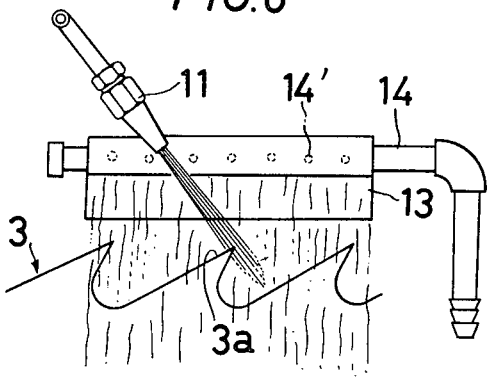

METHOD OF HARDENING SAW TEETH

DETAILED DESCRIPTION OF THE INVENTION

The present invention relates to a method for hardening sawteeth. More particularly, the invention relates to a method for hardening sawteeth which comprises contacting running water with the top ends of sawteeth in air, blowing flames to the top ends of the sawteeth in this state to thereby blow off the running water at parts enveloping the top ends of the sawteeth and heat only the top ends of the sawteeth at a hardening temperature, and then shifting the sawteeth to separate the sawteeth from a sphere of influence of the flames and simultaneously cool the sawteeth with the running water.

I already proposed a method for hardening sawteeth in which flames are blown to top ends of sawteeth in the state where the level of the top ends of the sawteeth is made in agreement with the level of water or the top ends of the sawteeth are slightly projected from the water level, whereby only the top ends of the sawteeth are selectively heated and hardened. According to this method, a substantial portion of a band saw must be submerged in water along a prescribed length, and hence, a water tank having a large capacity must be used. Further, since a band saw is passed through such large water tank in the state where it is submerged in water along a prescribed length, side walls of the water tank must be sealed at parts where the band saw travels, and therefore, the structure of the water tank is complicate.

Still further, since respective teeths of a saw generally differ in the width or length, it is very difficult to make the level of top ends of these sawteeth in agreement with the level of water or project them slightly from the water level. Accordingly, the hardening operation must be conducted very carefully and large labors and expenses are necessary for practising the above hardening method.

In addition, when the top ends of sawteeth are heated in the state where a substantial portion of the saw is submerged in water, water drops are scattered by shifting of the saw or blowing of flames. Therefore, even if all the top ends of the sawteeth are hardened under the same conditions, the temperature is not elevated to a prescribed level is some of the top ends of the sawteeth to which water drops are applied, and a prescribed hardness cannot be attained in these top ends.

It is a primary object of the present invention to provide a method for hardening sawteeth in which only top ends of sawteeth are selectively hardened at low costs without use of a special water tank for making the level of the top ends of the sawteeth quite in agreement with the level of water or projecting them slightly from the water level or other accompanying equipments for adjusting the height of the top ends of the sawteeth.

Another object of the present invention is to provide a method for hardening sawteeth in which the top ends of sawteeth can be uniformly hardened by a simple operation and a uniform hardness is attained in all the top ends of the sawteeth.

The present invention will now be described in detail by reference to embodiments shown in the accompanying drawings, in which:

FIG. 5 is a longitudinally sectional view illustrating another embodiment of the present invention; and FIG. 6 is a view illustrating the main parts in the embodiment shown in FIG. 5.

Figure 1:
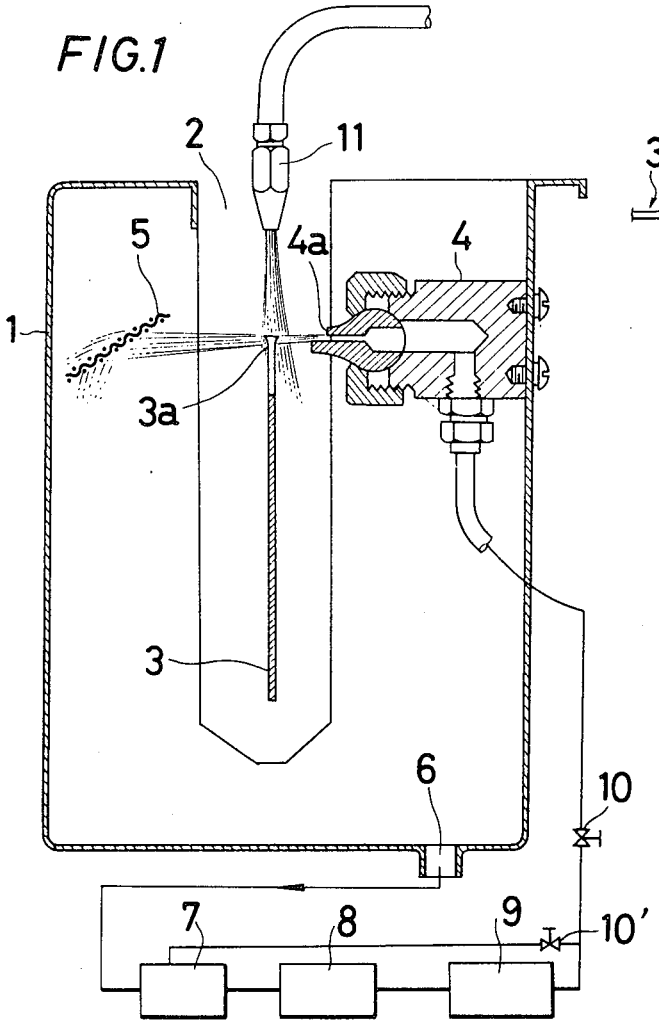
FIG. 1 is a view showing the longitudinal section of an apparatus to be used for practising the hardening method of the present invention.
Figure 2:
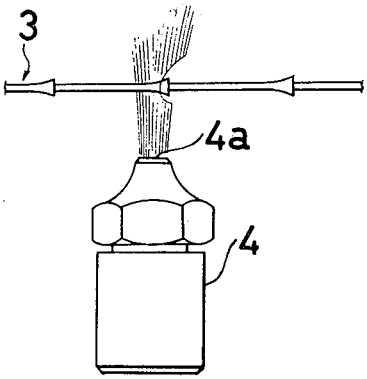
FIG. 2 is a plan view showing the hardening state.
Figure 4:
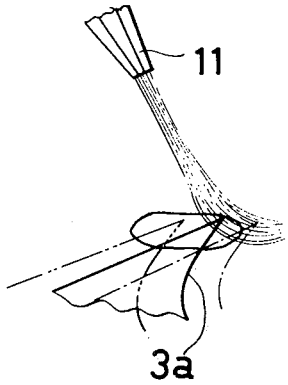
FIG. 4 is a side view showing heating and cooling of sawteeth.
Figure 3:
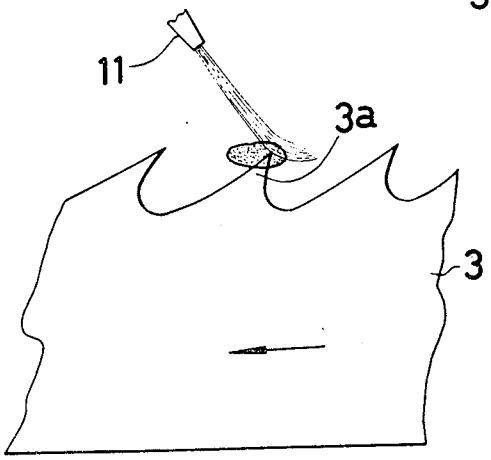
FIG. 3 is a side view showing the hardening state.

In the drawings, a reference numeral 1 denotes a water-receiving tank which has notched openings 2 on both the left and right side plates. A band saw 3 supported on a known intermittent transportation apparatus similar to that of a saw polishing machine passes through the notched openings 2 of the water-receiving tank 1. An injection nozzle 4 is vertically movably screwed to the inner face of the side wall of the water-receiving tank 1 which is in parallel to the plate face of the band saw 3, and an injection opening 4*a* of the injection nozzle 4 is designed so that the height is 0.3 to 0.5 mm and the lateral width is 1.5 to 2 mm. When seen from the lateral direction, the injection opening 4*a* is positioned at substantially the same level as that of top ends of sawteeth 3*a* of the band saw 3 passing through the water-receiving tank 1 as shown in FIG. 1, and when seen from substantially the same height as that of the top ends of the sawteeth 3*a*, the projection opening 4*a* is disposed to expand forwardly from a point slightly backward of the top ends of the sawteeth 3*a*(with respect to the moving direction of the band saw 3 indicated by an arrow in the drawings), as shown in FIGS. 2 to 4. Water is jetted from this injection nozzle 4 under a pressure of 0.2 to 0.3 $Kg/cm^2$ and water is contacted with the top ends of the sawteeth 3*a* in the form of a tape having a very small thickness in the vertical direction.

Injected and spattered water impinges on a scattering-preventing net 5 inclined downwardly on the side opposite to the band saw 3, and it is let to fall and is recycled to a tank 7 from a water discharge opening 6.

The tank 7 is connected to a circulation pump 9 through a strainer 8 and the circulation pump 9 is connected to the injection nozzle 4 through a water conduit provided with an adjusting valve 10. By operating this adjusting valve 10 appropriately, water is injected under the above pressure and recycled.

A flame nozzle 11 is disposed to face the stationary top ends of the sawteeth 3*a* in such a state that the nozzle is inclined in the plane including the plate face of the band saw 3 from above toward the backward in the moving direction of the band saw 3. A fuel gas comprising a mixture of acetylene gas and oxygen gas is jetted from this flame nozzle 11, and flames are blown out. However, as shown in FIGS. 2 and 4, by the above positional arrangement of the flame nozzle 11, the flames are not blown to the rear upper portion of the stream of injected water. Accordingly, in each sawtooth, a part lower than a point 1 to 2 mm below the top point of the sawtooth is covered with water and only the remaining upper part along a length of 1 to 2 mm is selectively heated.

The bank saw 3 is transmittently shifted by a rod reciprocated at a prescribed interval along a distance corresponding to one pitch of the saw band 3. The degree of blowing of flames or the interval of the transmittent shifting is adjusted so that the temperature of the top ends of the sawteeth is elevated to a prescribed hardening temperature while the band saw 3 is kept stationary. When this heating is completed and the band saw is shifted, the heated sawtooth is separated from the sphere of influence of flames and is immediately introduced into stream of injected water and instantaneously cooled. Thus, hardening is completed.

In the foregoing embodiment, since water and flame are injected in directions crossing each other and they are caused to strike against each other in such injected state to thereby expose only the top ends of sawteeth to flames from water streams, the boundery interface between the flame layer and the water layer can be stably set in any way. Incidentally, reference numeral 10' in the drawings indicates a relief valve.

Another embodiment of the present invention will now be described by reference to FIGS. 5 and 6. A water-receiving tank 1' has notched openings 2 as in the above-mentioned embodiment, and gutters 12 extending in parallel to a band saw 3 are disposed above both the sides of the band saw 3 passing through the notched openings 2. Water-flowing plates 13 are disposed in the inside portions of these gutters 12 so that the plates 13 are downwardly inclined toward the top ends of sawteeth and lower edges of the plates 13 are positioned just above the sawteeth 3*a*.

A pipe 14 having a plurality of flow-out openings 14' is contained in each of the gutters 12 and it is connected to a circulation pump 9 through a flow rate-adjusting valve 15. A water discharge opening 6 of the water-receiving tank 1' is opened onto a tank 7, and this tank 7 is connected to the circulation pump 9 through a strainer 8. When water is charged in the tank 7 and the circulation pump 9 is driven, water is discharged into the gutters 12 through the pipes 14 and stored therein. When a certain amount of water is stored in the gutters 12, water is flown down in a form of a thin film on the water-flowing plates 13 and is poured onto the sawteeth 3a as water contains from the lower ends of the water-flowing plates 13. Then, water arrives at the water discharge opening 6 and is then flown and recycled into the tank 7 from the opening 6.

As in the above-mentioned embodiment, above one sawtooth 3*a* enveloped in the water curtain a flame nozzle 11 is disposed so that as shown in FIG. 5, it is extended from just above the band saw when seen from the lengthwise direction of the band and it is directed upwardly and backwardly with respect to the moving direction of the band saw indicated by an arrow when seen from the lateral direction. A flame is blown out from the nozzle 11 toward the top end of one sawtooth 3*a* and hence, a water film covering the top end of the sawtooth 3*a* is removed by the force of the flame along a length of 0.5 to 2 mm (this length can be adjusted appropriately by controlling the flame force or the flow rate of water), as shown in FIG. 6. Thus, only the top end portion of the sawtooth 3*a* is selectively heated and the remaining lower portion is not heated because it is covered with a water film. Accordingly, the hardened part of the sawtooth can be clearly distinguished from the unhardened part.

When the temperature of the top end of the sawtooth 3*a* is elevated to a prescribed hardening temperature, the band saw 3 is moved intermittently. Accordingly, the heated sawtooth 3*a* is immediately introduced into the water curtain and rapidly cooled. Thus, hardening is completed.

As will be apparent from the foregoing illustration, according to the hardening method of the present invention comprising moving intermittently a band saw in the lengthwise direction thereof, forming in air a water stream running from a point forward at least from the top ends of sawteeth with respect to the moving direction of the band saw and contacting the water stream with the top ends of the sawteeth while the band saw is not moved, blowing flames to the top ends of the sawteeth in said state to blow away the running water at parts covering the top ends of the sawteeth by the force of the flames and heat only the top ends of the sawteeth at a prescribed hardening temperature, then moving the band saw again and cooling the heated top ends of the sawteeth by the running water, it is not necessary to use an expensive vessel of a large scale allowing passage of a band saw but not allowing flow-out of water, such as used in the method in which the substantial portion of a sawtooth except the top end is submerged in water, but hardening can be accomplished by using a very simple apparatus. Further, according to the method of the present invention, the heated area and the non-heated area can easily be arranged with a clear distinction by controlling appropriately the force of flames or the flow rate of running water. Still further, according to the method of the present invention, there is attained an advantage that all of sawteeth of one band saw can be heated under the same conditions and a uniform hardening effect can be obtained in all of the sawteeth.

What is claimed is:

1. A method for hardening sawteeth comprising moving intermittently a band saw in the lengthwise direction thereof, forming in air a water stream running from a point forward at least from the top ends of sawteeth with respect to the moving direction of the band saw and contacting the water stream with the top ends of the sawteeth while the band saw is not moved, blowing flames to the top ends of the sawteeth in said state to blow away the running water at parts covering the top ends of the sawteeth by the force of the flames and heat only the top ends of the sawteeth at a prescribed hardening temperature, then moving the band saw again and cooling the heated top ends of the sawteeth by the running water.

2. A hardening method according to claim 1 wherein the water stream is formed by injecting water from a nozzle having a small thickness in the vertical direction and a broad width in the lateral direction and said nozzle is faced to the top ends of the sawteeth in the lateral direction.

3. A hardening method according to claim 1 wherein the water stream is formed as a thin band-like film flowing down to the top ends of the sawteeth obliquely from above the top ends of the sawteeth.

4. A hardening method according to claim 1 wherein the running water is received in a water-receiving tank and recycled to a water-injecting nozzle by means of a pump.

* * * * *